US009929541B2

(12) United States Patent
Saito et al.

(10) Patent No.: US 9,929,541 B2
(45) Date of Patent: Mar. 27, 2018

(54) IGNITION PLUG AND IGNITION DEVICE

(71) Applicant: NGK SPARK PLUG CO., LTD., Nagoya-shi, Aichi (JP)

(72) Inventors: Hirotaka Saito, Komaki (JP); Kohei Usami, Nagoya (JP); Kenji Ban, Gifu (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/658,794

(22) Filed: Jul. 25, 2017

(65) Prior Publication Data

US 2018/0041013 A1 Feb. 8, 2018

(30) Foreign Application Priority Data

Aug. 3, 2016 (JP) ..... 2016-152704

(51) Int. Cl.
*H01T 13/20* (2006.01)
*H01T 13/36* (2006.01)
*F02P 15/00* (2006.01)

(52) U.S. Cl.
CPC ..... *H01T 13/36* (2013.01); *F02P 15/00* (2013.01)

(58) Field of Classification Search
USPC ..... 123/169 EL
See application file for complete search history.

(56) References Cited

U.S. PATENT DOCUMENTS

2014/0144402 A1* 5/2014 Okabe ..... H01T 13/467 123/169 EL

FOREIGN PATENT DOCUMENTS

JP 2014-022341 A 2/2014 ..... F02P 13/00

* cited by examiner

*Primary Examiner* — Ashok Patel
(74) *Attorney, Agent, or Firm* — Kusner & Jaffe

(57) ABSTRACT

An ignition plug capable of improving ignition performance while preventing pre-ignition includes a center electrode, a bottomed cylindrical insulator enclosing a front end portion of the center electrode and a cylindrical metal shell holding therein the insulator. The insulator has, on a front end side thereof, a protruding portion protruding from and located frontward of a front end of the metal shell. In the ignition plug, a difference between an outer diameter of the center electrode and an inner diameter of the insulator is 0.01 mm or more; an axial length of the protruding portion is 6.7 mm to 12.7 mm; and the following condition is satisfied: $1.07 \leq S/V1 \leq 1.35$ where S is an outer surface area of the protruding portion; and V1 is a volume of the protruding portion.

6 Claims, 5 Drawing Sheets

IGNITION PLUG AND IGNITION DEVICE

RELATED APPLICATIONS

This application claims the benefit of Japanese Patent Application No. 2016-152704, filed Aug. 3, 2016, the entire contents of which are incorporated herein by reference.

FIELD OF THE INVENTION

The present invention relates to an ignition plug, particularly of the type capable of improving ignition performance while preventing pre-ignition. The present invention also relates to an ignition device with the ignition plug.

Hereinafter, the term "front" refers to a side closer to a combustion chamber of an internal combustion engine with respect to the direction of an axis of an ignition plug; and the term "rear" refers to a side opposite the front side.

BACKGROUND OF THE INVENTION

Japanese Laid-Open Patent Publication No. 2014-22341 (abbreviated as JP 2014-22341 A) discloses an ignition plug for ignition of air-fuel mixture by non-equilibrium plasma in a combustion chamber of an internal combustion engine. This ignition plug includes a center electrode, a bottomed cylindrical insulator enclosing a front end portion of the center electrode, and a metal shell holding therein the insulator, with a front end portion of the insulator protruding from a front end of the metal shell, so that non-equilibrium plasma is generated in a space around the insulator for ignition of air-fuel mixture. The ignition performance of the ignition plug is improved as the amount of generation of non-equilibrium plasma is increased with increase in the surface area of the front end portion of the insulator.

However, the larger the surface area of the front end portion of the insulator, the more susceptible the front end portion of the insulator is to heat of combustion gas. When the surface temperature of the heated insulator becomes excessively high, there arises a problem of pre-ignition due to heat from the insulator.

On the other hand, the larger the volume of the insulator becomes with increase in the surface area of the front end portion of the insulator, the more easily the heat can be radiated (dissipated) from the front end portion of the insulator through the insulator. When the surface temperature of the front end portion of the insulator becomes low, it is likely that carbon will be deposited on the front end portion of the insulator. Due to such carbon deposition, it becomes difficult to generate non-equilibrium plasma so that there arises a problem of deterioration in ignition performance.

The present invention has been made to solve the above-mentioned problems. An advantage of the present invention is an ignition plug capable of improving its ignition performance while preventing pre-ignition.

SUMMARY OF THE INVENTION

According to a first aspect of the present invention, there is provided an ignition plug, comprising: a center electrode extending along an axis of the ignition plug; a bottomed cylindrical insulator enclosing a front end portion of the center electrode; and a cylindrical metal shell holding therein the insulator, the insulator having, on a front end side thereof, a protruding portion protruding from and located frontward of a front end of the metal shell, wherein a difference between an outer diameter of the center electrode and an inner diameter of the insulator is 0.01 mm or more; wherein a length of the protruding portion in a direction of the axis is 6.7 mm to 12.7 mm; and wherein the following condition is satisfied: $1.07 \leq S/V1 \leq 1.35$ where S is an area of an outer surface of the protruding portion; and V1 is a volume of the protruding portion.

In this configuration, it is possible to ensure not only the outer surface area of the protruding portion but also the sufficient heat dissipation from the protruding portion through the insulator so that pre-ignition can be prevented from being caused due to heat from the insulator. It is further possible to suppress a decrease in the amount of generation of non-equilibrium plasma. Accordingly, the ignition plug attains improved ignition performance while preventing pre-ignition.

In accordance with a second aspect of the present invention, there is provided an ignition plug as described above that is configured such that: the following condition is further satisfied: $0.01 \leq V2/(V1+V2+V3) \leq 0.49$ where V2 is a volume of the front end portion of the center electrode located frontward of the front end of the metal shell; and, assuming a clearance between the insulator and the center electrode, V3 is a volume of a part of the clearance located frontward of the front end of the metal shell.

In this configuration, it is possible to more effectively ensure both the amount of heat dissipation from the protruding portion through the insulator and the amount of generation of non-equilibrium plasma around the protruding portion. Thus, the ignition plug obtains more ignition performance improvement and pre-ignition prevention effects.

In accordance with a third aspect of the present invention, there is provided an ignition plug as described above that is configured such that: the protruding portion includes a first region formed with a first outer diameter and a second region located frontward of the first region and formed with a constant second outer diameter smaller than the first outer diameter; and a thickness of the second region in a direction perpendicular to the axis is 0.75 mm to 2.4 mm.

In this configuration, it is possible to ensure not only the amount of generation of non-equilibrium plasma around the second region but also the withstand voltage of the second region. The ignition plug thus obtains ignition performance improvement and pre-ignition prevention effects without lowering of the withstand voltage.

In accordance with a fourth aspect of the present invention, there is provided an ignition plug as described above that is alternatively configured such that: the protruding includes a first region formed with a first outer diameter, a second region located frontward of the first region and formed with a constant second outer diameter smaller than the first outer diameter, and a third region extending between the first region and the second region; and, when viewed in cross section along the axis, an outer surface of the third region has an tapered shape that gradually increases in diameter from the front toward the rear.

In this configuration, it is possible to easily generate non-equilibrium plasma even around the third region so that the total amount of generation of non-equilibrium plasma around the protruding portion can be increased. The ignition plug attains further improvement of ignition performance while preventing pre-ignition.

In accordance with a fifth aspect of the present invention, there is provided an ignition plug as described above that is configured such that the outer surface of the protruding portion is formed with an uneven section.

In this configuration, it is possible to increase the outer surface area of the protruding portion without increasing the length of the protruding portion in the direction of the axis, i.e., possible to relatively freely set the outer surface area and volume of the protruding portion. Thus, the ignition plug can be easily designed so as to attain improved ignition performance and prevent pre-ignition.

According to another aspect of the present invention, there is provided an ignition device, comprising: the above ignition plug; and a voltage application unit that applies an alternating voltage or a plurality of voltage pulses to the center electrode of the ignition plug so as to generate non-equilibrium plasma at an outer side of the protruding front end portion of the insulator.

In this configuration, the ignition device obtains the same effects as those of the above ignition plug.

These and other advantages and features of the present invention will also become understood from the following description.

DETAILED DESCRIPTION OF THE PREFERRED EMBODIMENTS

First Embodiment

A first embodiment of the present invention will be described below with reference to FIGS. 1 to 3.

Figure 1:
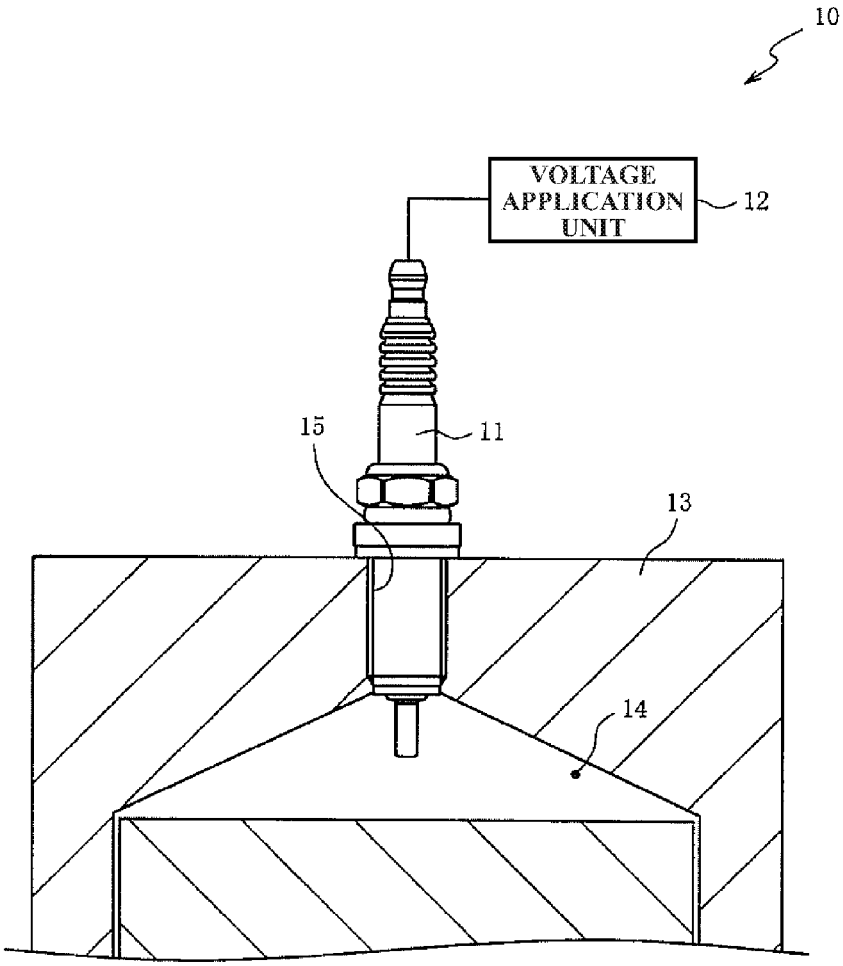
FIG. 1 is a schematic view of an ignition device with an ignition plug according to a first embodiment of the present invention.

FIG. 1 is a schematic view of an ignition device 10 for an internal combustion engine 13 according to the first embodiment of the present invention. As shown in FIG. 1, the ignition device 10 is provided with an ignition plug 11 and a voltage application unit 12.

The ignition plug 11 is mounted in a threaded mounting hole 15 of the internal combustion engine 13, with a front end part of the ignition plug 11 being exposed to the inside of a combustion chamber 14 of the internal combustion engine 13, and is electrically connected at a rear end part thereof to the voltage application unit 12.

The voltage application unit 12 is arranged to receive a supply of power from a battery (not shown) and apply an alternating voltage or a plurality of voltage pulses to the ignition plug 11 whereby the ignition plug 11 generates non-equilibrium plasma to cause ignition of air-fuel mixture in the combustion chamber 14.

Figure 2:
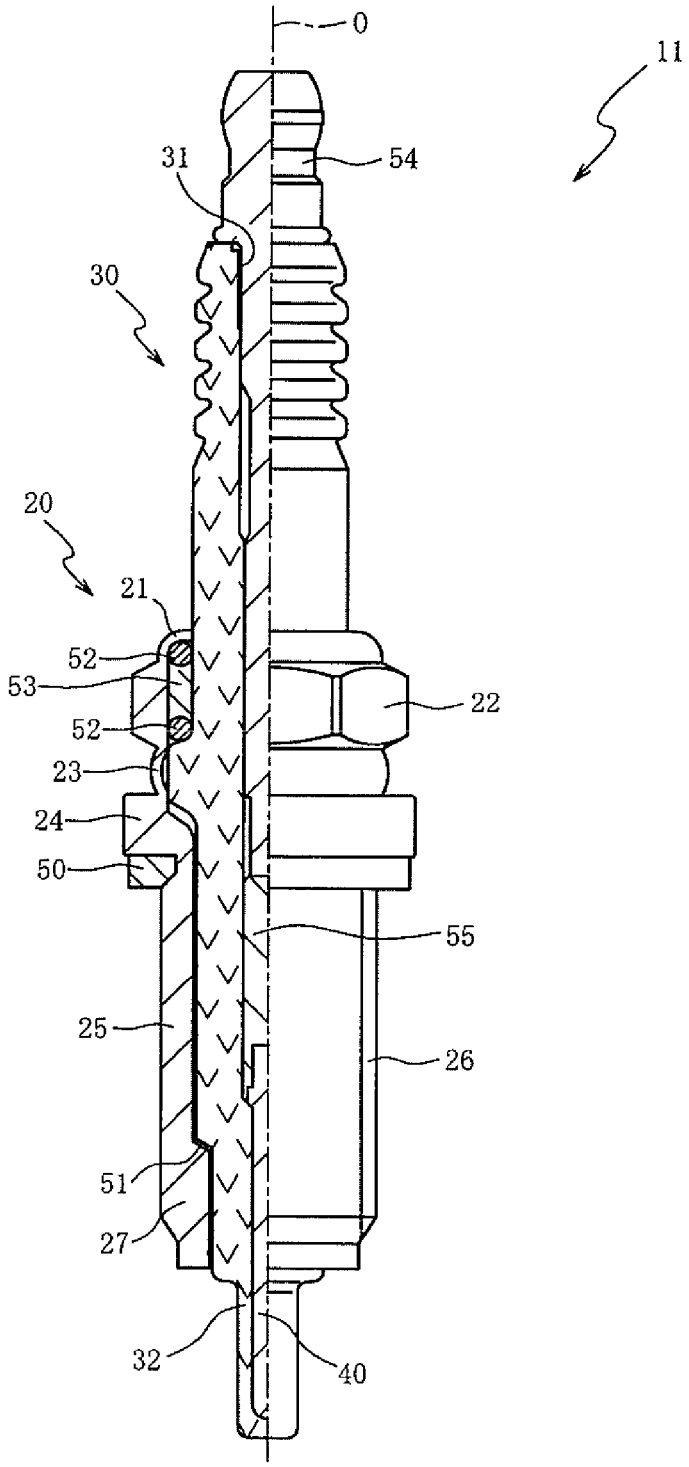
FIG. 2 is an elevation view, partially in section, of the ignition plug according to the first embodiment of the present invention.
Figure 3:
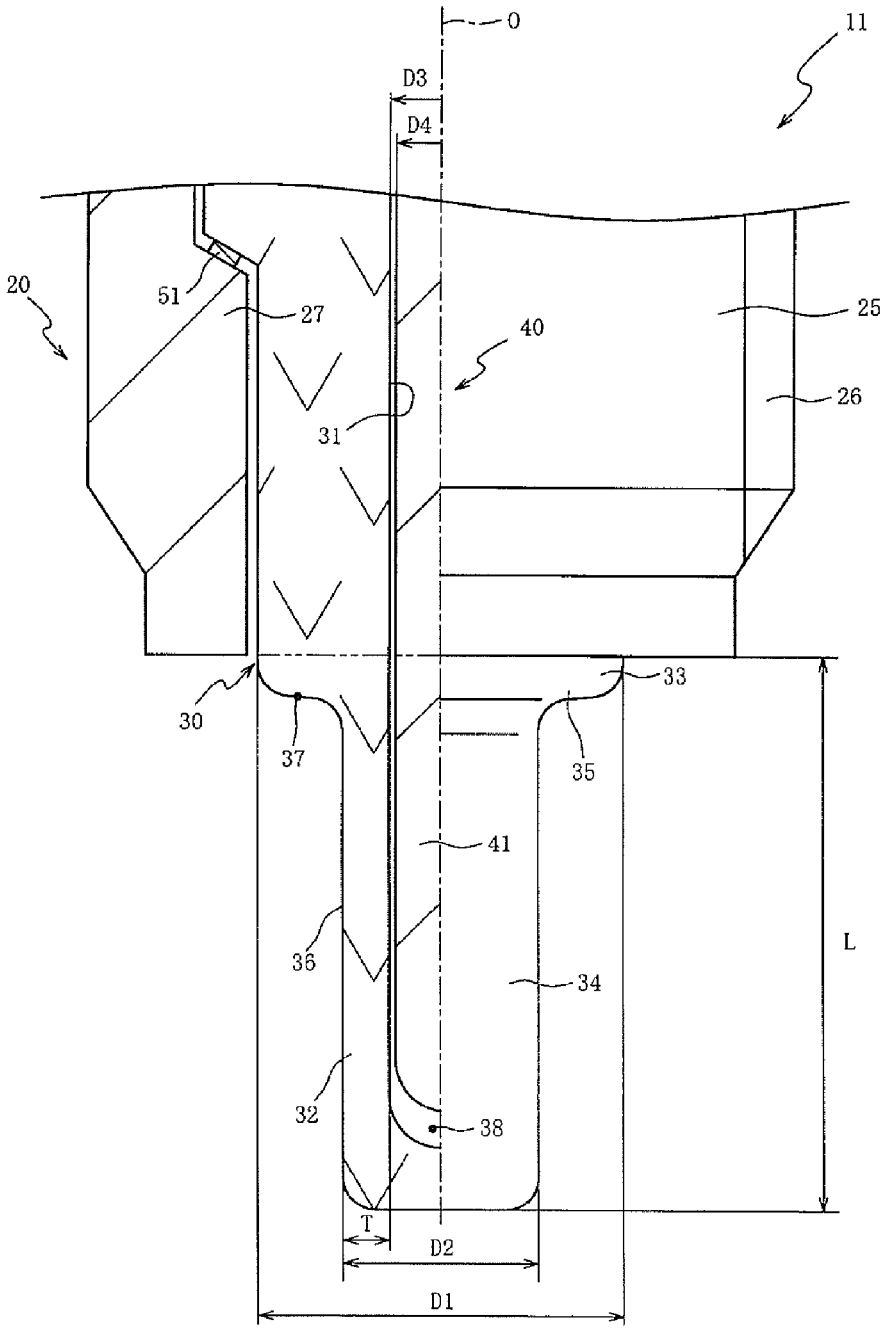
FIG. 3 is an enlarged view, half in section, of a front end part of the ignition plug according to the first embodiment of the present invention.

FIG. 2 is an elevation view, partially in section, of the ignition plug 11. In FIG. 2, an axis of the ignition plug 11 is designated as "O". The bottom side of FIG. 2 corresponds to a front side of the ignition plug 11; and the top side of FIG. 2 corresponds to a rear side of the ignition plug 11. In the following description, the term "axial" refers to a direction of the axis O; and the term "radial" refers to a direction perpendicular to the axis O. As shown in FIG. 2, the ignition plug 11 includes a metal shell 20, an insulator 30 and a center electrode 40.

The metal shell 20 is made of a conductive metal material (such as low carbon steel) in a substantially cylindrical shape and is fixed by screwing in the mounting hole 15 of the internal combustion engine 13 (see FIG. 1).

More specifically, the metal shell 20 has a crimp portion 21, a tool engagement portion 22, a curved portion 23, a seat portion 24 and a body portion 25 located in this order from the rear side to the front side along the direction of the axis O. A thread 26 is formed on an outer circumferential surface of the body portion 25. The crimp portion 22 and the curved portion 23 are formed by crimping of the metal shell 20 onto the insulator 3. The tool engagement portion 22 is formed such that a tool such as wrench for screwing the thread 26 in the mounting hole 15 (see FIG. 1) can be engaged on the tool engagement portion 22. The seat portion 24 is formed in a radially outwardly protruding annular shape at a position rearward of the body portion 25. An annular gasket 50 is disposed between the seat portion 24 and the body portion 25. When the thread 26 is screwed into the mounting hole 15, the gasket 50 is held between the seat portion 24 and the internal combustion engine 13 so as to seal a clearance between the mounting hole 15 and the metal shell 20 (thread 26). Further, the body portion 25 has a radially inwardly protruding section 27 formed on an inner circumference thereof. An annular plate-shaped packing 51, which is made of a metal material (such as soft steel plate) softer than the metal material of the metal shell 20, is disposed on a rear-facing surface of the radially inwardly protruding section 27.

The insulator 30 is made of e.g. alumina having good mechanical properties and high-temperature insulating properties and has a bottomed cylindrical shape with an axial hole 31 closed at a front end thereof and open at a rear end thereof. The insulator 30 is inserted in the metal shell 20 so that the metal shell 20 is fixed on an outer circumference of the insulator 30.

Ring members 52 are disposed between the outer circumference of the insulator 30 and an inner circumference of the tool engagement portion 22 of the metal shell 20. Further, a filling material 63 such as talc is disposed in a space between the ring members 52, the outer circumference of the insulator 30 and the inner circumference of the tool engagement portion 22 of the metal shell 20. When the crimp portion 21 of the metal shell 20 is crimped radially inwardly onto the insulator 30, the insulator 30 is pushed to the radially inwardly protruding section 27 of the metal shell 20 through the ring members 52 and the filling material 53. As a result, the insulator 30 is held in the metal shell 20 via the packing 51, the ring members 52 and the filling material 53. In a state where the insulator 30 is held in position in the metal shell 20, a front end portion 32 of the insulator 30 protrudes from a front end of the metal shell 20. (The front end portion 32 is hereinafter referred to as "protruding portion".)

The center electrode 40 is made of a conductive metal material (such as nickel-based alloy) in a rod shape and is fitted in the axial hole 31 of the insulator 30.

The ignition plug 11 further includes a metal terminal 54 made of a conductive metal material (such as low carbon steel) in a rod shape and having a front end portion inserted in the axial hole 31 of the insulator 30 and a rear end portion to which the voltage application unit 12 is connected (see FIG. 1). A conductive seal member 55 is disposed between the metal terminal 54 and the center electrode 40 such that the center electrode 40 and the metal terminal 54 are electrically connected to each other via the seal member 55 within the axial hole 31.

The configuration of the ignition plug 11 will be explained in more detail below with reference to FIG. 3. FIG. 3 is an enlarged view, half in section, of the front end part of the ignition plug 11. As mentioned above and as shown in FIG. 3, the protruding portion 32 of the insulator 30 protrudes from the front end of the metal shell 20. Herein, the protruding portion 32 is defined as a portion of the insulator 30 located frontward of the front end of the metal shell 20 in the direction of the axis O. An axial length L of the protruding portion 32 is set to 6.7 mm to 12.7 mm so as to ensure a sufficient outer surface 36 of the protruding portion 32.

In the first embodiment, the protruding portion 32 includes a cylindrical first region 33 located at a rear end side thereof (top side of FIG. 3), a bottomed cylindrical second region 34 located at a front end side thereof, and a cylindrical third region 35 extending between the first region 33 and the second region 34. The first region 33 has a first outer diameter D1. The second region 34 has a constant second outer diameter D2 smaller than the outer diameter D1. The third region 35 is stepped in shape such that, when viewed in cross section along the axis O, the outer surface 36 of the third region 35 of the protruding portion 32 is formed in a smoothly curved shape with an inflection point 37. In this ignition plug 11, non-equilibrium plasma is mainly generated in a space around the outer surface 36 of the first and second regions 33 and 34 of the protruding portion 32.

An inner diameter D3 of the axial hole 31 of the insulator 30 is set substantially constant throughout its length except for a front end of the insulator 30. Namely, a radial thickness T of the second region 34 is made smaller than that of the first region 33.

The radial thickness T of the second region 34 is set to 0.75 mm to 2.4 mm in the first embodiment. When $T<0.75$ mm, the withstand voltage of the second region 34 is lowered so that perforation or cracking is likely to occur. When $T>2.4$ mm, the amount of generation of non-equilibrium plasma around the second region 34 is decreased so that the ignition performance of the ignition plug 11 tends to be deteriorated. By satisfying the condition of $0.75\text{ mm}\leq T\leq 2.4$ mm, it is possible to suppress lowering of the withstand voltage of the second region 34 while ensuring the amount of generation of non-equilibrium plasma around the second region 34.

Furthermore, an axial length of the second region 34 is set longer than that of the first region 33. It is thus possible to increase the amount of generation of non-equilibrium plasma as compared to the case where the axial length of the second region 34 is shorter than that of the first region 33.

In the insulator 30, a front end portion 41 of the center electrode 40 is surrounded and enclosed by the protruding portion 32. Herein, the front end portion 41 is defined as a portion of the center electrode 40 located frontward of the front end of the metal shell 20 in the direction of the axis O.

A difference between the inner diameter D3 of the axial hole 31 of the insulator 30 and an outer diameter D4 of the front end portion 41 of the center electrode 40 (hereinafter also referred to as "diameter difference (D3−D4)") is set to 0.01 mm or larger. By this diameter difference, there is a radial clearance space left between an inner circumferential surface of the axial hole 31 and an outer circumferential surface of the front end portion 41. There is also an axial clearance space 38 left between a bottom of the axial hole 31 and an end surface of the front end portion 41. This clearance space 38 is defined as, among a clearance between the center electrode 40 and the axial hole 31, a spacial part located frontward of the front end of the metal shell 20 in the direction of the axis O.

In the first embodiment, the ignition plug 11 is adapted to satisfy the condition of $1.07\leq S/V1\leq 1.35$ where S is an area (in units of $mm^2$) of the outer surface 36 of the protruding portion 32; and V1 is a volume (in units of $mm^3$) of the protruding portion 32. The control of this surface-to-volume ratio S/V1 (in units of 1/mm) is to ensure not only the surface area S of the outer surface 36 of the protruding portion 32 but also the sufficient heat dissipation from the protruding portion 32 through the insulator 30 under a condition that the axial length L of the protruding portion 32 is set to 6.7 mm to 12.7 mm as mentioned above.

When $S/V1<1.07$, the ratio of the surface area S to the volume V1 of the protruding portion 32 is low so that the amount of non-equilibrium plasma generated around the outer surface 36 of the protruding portion 32 becomes decreased. The ignition performance of the ignition plug 11 is thus deteriorated with a decrease in the amount of generation of non-equilibrium plasma. Further, when $S/V1<1.07$, the ratio of the volume V1 to the surface area S of the protruding portion 32 is high so that heat can be easily dissipated from the protruding portion 32 to the outside of the internal combustion engine 13 (see FIG. 1) through the insulator 13. As the temperature of the protruding portion 32 is lowered, it is likely that carbon will be deposited on the outer surface 36 of the protruding portion 32. Due to carbon deposition, it becomes difficult to generate non-equilibrium plasma. The ignition performance of the ignition plug 11 is thus also deteriorated with a decrease in the amount of generation of non-equilibrium plasma.

On the other hand, when $S/V1>12.7$, the ratio of the surface area S to the volume V1 of the protruding portion 32 is high so that the protruding portion 32 becomes more susceptible to heat of combustion gas. Further, when $S/V1>12.7$, the ratio of the volume V1 to the surface area S of the protruding portion 32 is low so that it becomes difficult to dissipate heat from the protruding portion 32 through the insulator 30. As the outer surface 36 of the protruding portion 32 is heated to an excessively high temperature, there occurs pre-ignition due to heat from the protruding portion 32.

By satisfying the condition of $1.07\leq S/V1\leq 1.35$, it is possible to solve the above-mentioned problems and achieve both improvement of ignition performance and prevention of pre-ignition.

In the first embodiment, the ignition plug 11 is also adapted to satisfy the condition of $0.01\leq V2/(V1+V2+V3)\leq 0.49$ where V1 is the volume of the protruding portion 32 of the insulator 30; V2 is a volume of the front end portion 41 of the center electrode 40; and V3 is a volume of the clearance space 38 between the end surface of the center electrode 40 and the axial hole 31.

When $V2/(V1+V2+V3)<0.01$, the ratio of the volume V2 of the front end portion 41 (center electrode 40) is low so that the distance between the surface of the front end portion 41 and the outer surface 36 of the protruding portion 32 becomes large. In this case, it is difficult to cause plasma discharge. The ignition performance of the ignition plug 11 is thus deteriorated with a decrease in the amount of generation of non-equilibrium plasma.

When $V2/(V1+V2+V3)>0.49$, the ratio of the volume V2 of the front end portion 41 (center electrode 40) is high so that heat can be easily dissipated from the protruding portion 32 through the center electrode 40. As the temperature of the protruding portion 32 is lowered, it is likely that carbon will be deposited on the outer surface 36 of the protruding portion 32. Due to carbon deposition, it becomes difficult to generate non-equilibrium plasma. The ignition performance of the ignition plug 11 is thus also deteriorated with a decrease in the amount of generation of non-equilibrium plasma.

By satisfying the condition of $0.01 \leq V2/(V1+V2+V3) \leq 0.49$, it is possible to solve the above-mentioned problems and ensure both of the amount of heat dissipation from the protruding portion 32 through the center electrode 40 and the amount of non-equilibrium plasma generated around the protruding portion 32 for improvement of ignition performance and prevention of pre-ignition.

Second Embodiment

Next, a second embodiment of the present invention will be described below with reference to FIG. 4. The second embodiment is similar to the first embodiment, except for the configuration of an ignition plug 60. In the second embodiment, the same parts and portions as those in the first embodiment are designated by the same reference numerals; and a detailed explanation thereof shall be omitted herefrom.

Figure 4:
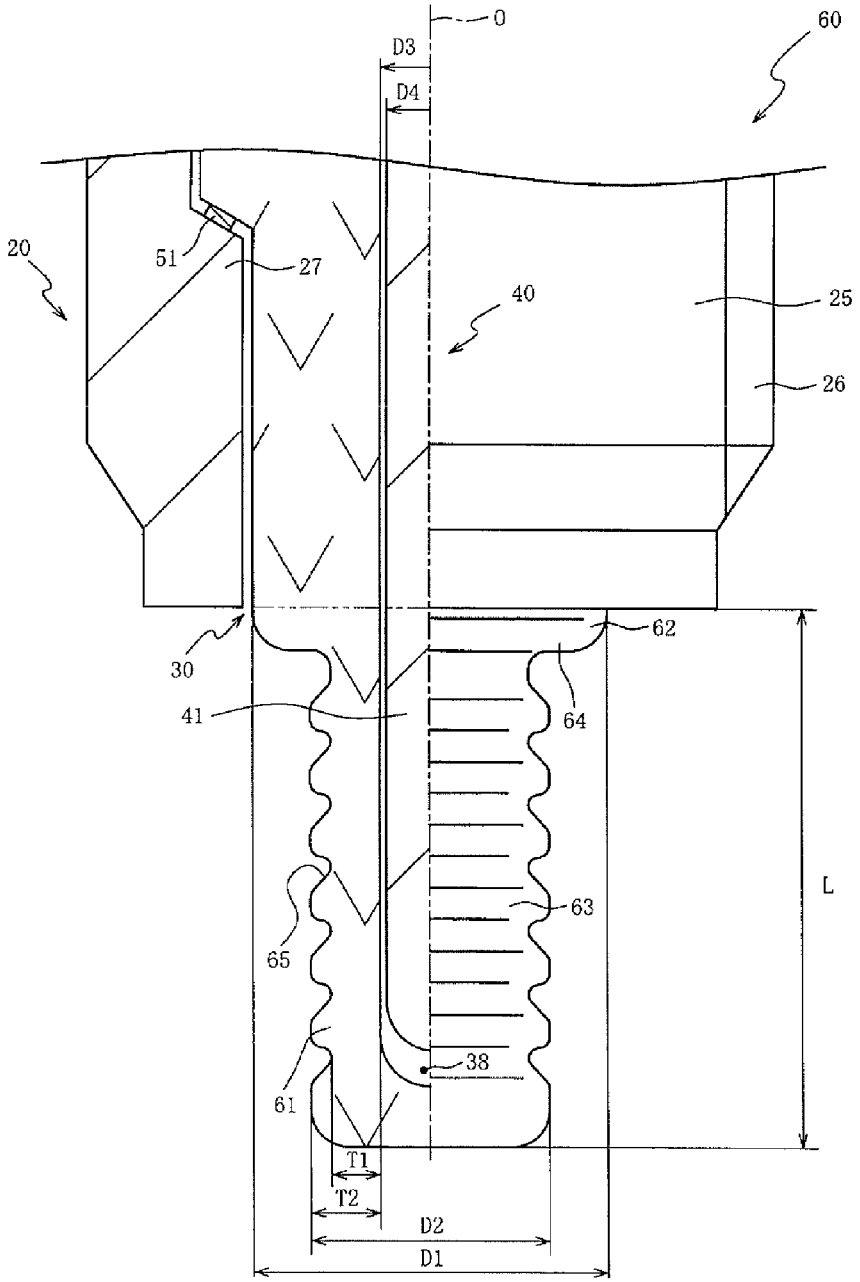
FIG. 4 is an enlarged view, half in section, of a front end part of an ignition plug according to a second embodiment of the present invention.

FIG. 4 is an enlarged view, half in section, of a front end part of the ignition plug 60. The ignition plug 60 of the second embodiment is different from the ignition plug 11 of the first embodiment in that, although the outer surface of the second region 34 of the protruding portion 32 of the insulator 30 is flat (i.e. the outer diameter of the second region 34 is constant) throughout its length in the direction of the axis O in the first embodiment, a protruding portion (front end portion) 61 of the insulator 30 has an outer surface formed with an uneven section 65 in the second embodiment.

In the ignition plug 60, the protruding portion 61 of the insulator 30 protrudes from the front end of the metal shell 20. As in the case of the first embodiment, an axial length L of the protruding portion 61 is set to 6.7 mm to 12.7 mm in the second embodiment.

In the second embodiment, the protruding portion 61 includes a cylindrical first region 62 located at a rear end side thereof (top side of FIG. 4), a bottomed cylindrical second region 63 located at a front end side thereof, and a cylindrical third region 64 extending between the first region 62 and the second region 63. The first region 62 has a first outer diameter D1. The second region 63 has a constant second outer diameter D2 smaller than the outer diameter D1. The third region 64 has a curved stepped shape.

The uneven section 65 is provided on the outer surface of the second region 63 by e.g. forming a plurality of circumferentially continuous annular recesses at intervals apart from one another in the direction of the axis O. A thickness T1 of valley parts (recessed parts) of the uneven section 65 (i.e. a minimum thickness of the second region 63) and a thickness T2 of peak parts (projecting parts) of the uneven section 65 (i.e. a maximum thickness of the second region 63) are set to 0.75 mm to 2.4 mm. The control of these thicknesses T1 and T2 is to ensure both the amount of generation of non-equilibrium and the withstand voltage of the second region 63.

In the second embodiment, the ignition plug 60 is adapted to satisfy the condition of $1.07 \leq S/V1 \leq 1.35$ as in the case of the first embodiment. By the formation of the uneven section 65, the outer surface area S and volume V of the protruding portion 61 can be relatively freely set irrespective of the axial length L of the protruding portion 61. It is therefore possible in the second embodiment to obtain the same effects as in the first embodiment and, at the same time, allow easy designing of the ignition plug 60 with improved ignition performance and no or less pre-ignition problem.

Third Embodiment

A third embodiment of the present invention will be next described below with reference to FIG. 5. The third embodiment is similar to the first and second embodiments, except for the configuration of an ignition plug 70. In the third embodiment, the same parts and portions as those in the first and second embodiments are designated by the same reference numerals; and a detailed explanation thereof shall be omitted herefrom.

Figure 5:
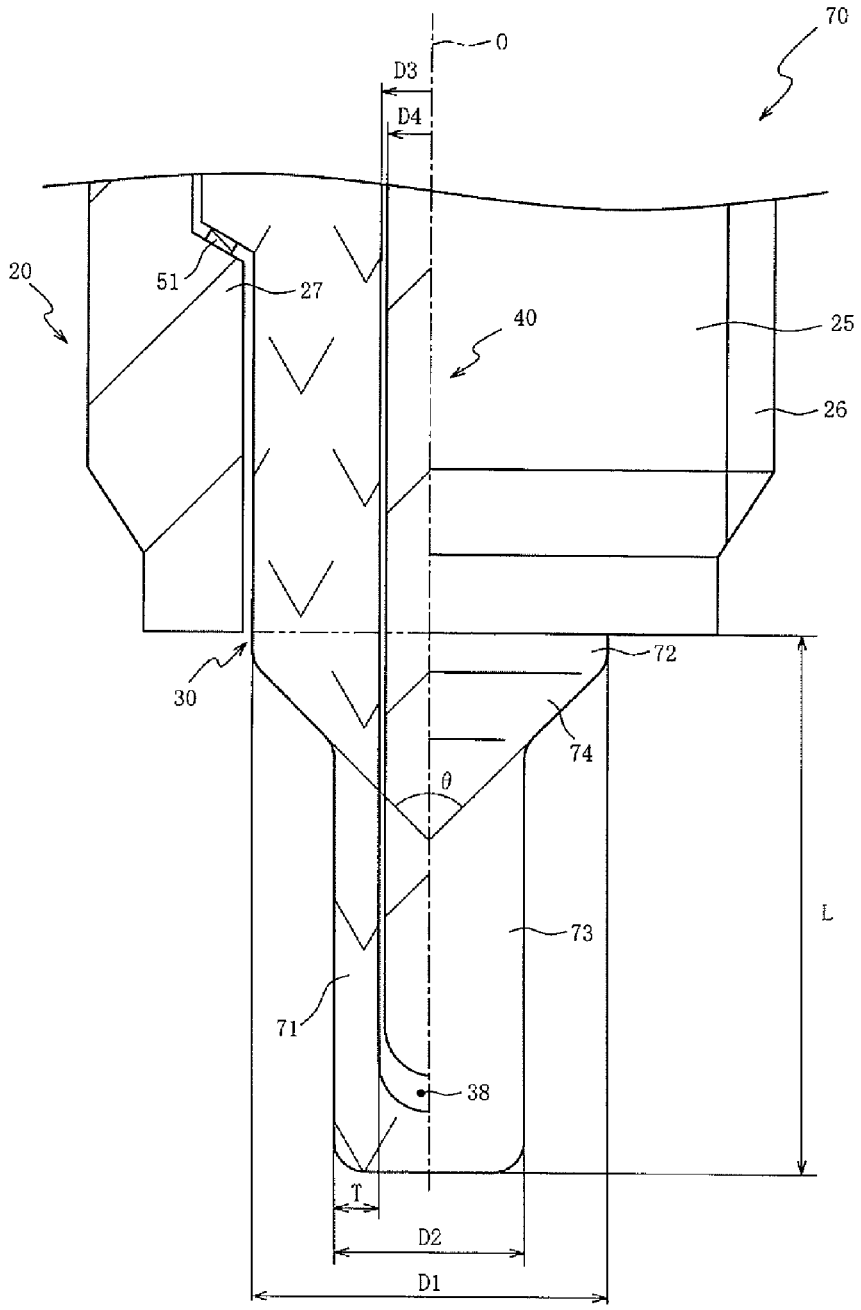
FIG. 5 is an enlarged view, half in section, of a front end part of an ignition plug according to a third embodiment of the present invention.

FIG. 5 is an enlarged view, half in section, of a front end part of the ignition plug 70. The ignition plug 70 of the third embodiment is different from the ignition plug 11 of the first embodiment in that, although the third region 35, 64 of the protruding portion 32, 64 of the insulator 30 is formed in a curved stepped shape in each of the first and second embodiments, a protruding portion 71 of the insulator 30 has a third region 74 formed in a tapered shape in the third embodiment.

In the ignition plug 70, the protruding portion 71 of the insulator 30 protrudes from the front end of the metal shell 20. As in the case of the first and second embodiments, an axial length L of the protruding portion 71 is set to 6.7 mm to 12.7 mm in the third embodiment.

In the third embodiment, the protruding portion 71 includes a cylindrical first region 72 located at a rear end side thereof (top side of FIG. 5), a bottomed cylindrical second region 73 located at a front end side thereof, and the cylindrical tapered third region 74 extending between the first region 72 and the second region 73. The third region 74 has a conical outer surface tapered down such that an outer diameter of the third region 74 gradually increases from the front side toward the rear side. By the formation of such a conical tapered outer surface on the third region 74, non-equilibrium plasma can also be easily generated around the outer surface of the third region 74. It is thus possible to increase the total amount of generation of non-equilibrium plasma around the protruding portion 71.

A taper angle θ of the third region 74 varies depending on outer diameters of the first and second regions 72 and 73. Preferably, the taper angle of the third region 74 is in a range of 30° to 120°. When $\theta < 30°$, the axial length of the third region 74 becomes long so that the outer surface area of the second region 73 is decreased with decrease in the axial length of the second region 73. Thus, the amount of generation of non-equilibrium plasma tends to be decreased. When $\theta > 120°$, the amount of generation of non-equilibrium plasma around the third region 74 is small. Thus, the plasma generation effect of the tapered third region 74 becomes poor.

Further, the ignition plug 70 is adapted to satisfy the condition of $1.07 \leq S/V1 \leq 1.35$ in the third embodiment as in the case of the first and embodiments. As the amount of generation of non-equilibrium plasma can be increased by the formation of the tapered third region 74, it is possible in the third embodiment to obtain the same effects as in the first embodiment and, at the same time, achieve further improvement of ignition performance.

EXAMPLES

The present invention will be described in more detail below by way of the following experiments.

Experiment 1

Sample ignition plugs (sample No. 1 to 27) of the same structure as the ignition plug 11 of the first embodiment were formed by varying the axial length L of the protruding portion, the outer diameter D2 of the second region and the surface-to-volume ratio S/V1 of the protruding portion. There were formed additional sample ignition plugs satisfying the condition of $1.07 \leq S/V1 \leq 1.35$ by setting the axial length of the protruding portion to 4.7 mm or to longer than 12.7 mm.

Each of the sample ignition plugs was mounted to a 1.6-liter four-cylinder DOHC engine and tested for the fuel-lean-side air-fuel ratio (referred to as "lean limit") at the time the stability of the engine reached a permissible limit level. During the test, the engine was operated under the conditions of a speed of 1200 rpm and a load (net mean effective pressure (NMEP)) of 500 kPa; and an alternating voltage was applied to the ignition plug so as to control the ignition timing to MBT (minimum advance for best torque) point in each operation. The stability of the engine was evaluated in terms of the coefficient of variance (COV) of the NMEP. The permissible stability limit level of the engine was set to COV=5%.

The test results are shown in TABLE 1. In the case where misfire of the engine occurred during the test, "-" is indicated in place of the air-fuel ratio value in the "lean limit" column of TABLE 1.

TABLE 1

| No. | L (mm) | D2 (mm) | S ($mm^2$) | V1 ($mm^3$) | S/V1 (1/mm) | Lean limit |
|---|---|---|---|---|---|---|
| 1 | 12.7 | 7.4 | 319.0 | 308.0 | 1.04 | — |
| 2 | 12.7 | 7.1 | 309.8 | 295.9 | 1.05 | — |
| 3 | 12.7 | 6.5 | 289.0 | 270.1 | 1.07 | 16.5 |
| 4 | 12.7 | 5.9 | 264.4 | 243.7 | 1.08 | 17.0 |
| 5 | 12.7 | 5.3 | 243.6 | 217.8 | 1.12 | 18.0 |
| 6 | 12.7 | 4.7 | 224.7 | 193.6 | 1.16 | 18.5 |
| 7 | 12.7 | 4.1 | 200.0 | 167.1 | 1.20 | 18.5 |
| 8 | 12.7 | 3.5 | 180.8 | 141.6 | 1.28 | 19.0 |
| 9 | 12.7 | 2.9 | 158.5 | 114.6 | 1.38 | 20.0 |
| 10 | 9.7 | 7.4 | 249.2 | 239.3 | 1.04 | — |
| 11 | 9.7 | 7.1 | 242.9 | 230.5 | 1.05 | — |
| 12 | 9.7 | 6.5 | 227.8 | 211.3 | 1.08 | 15.8 |
| 13 | 9.7 | 5.9 | 208.8 | 191.6 | 1.09 | 16.5 |
| 14 | 9.7 | 5.3 | 193.7 | 172.3 | 1.12 | 17.0 |
| 15 | 9.7 | 4.7 | 180.4 | 154.7 | 1.17 | 17.0 |
| 16 | 9.7 | 4.1 | 161.4 | 134.8 | 1.20 | 17.5 |
| 17 | 9.7 | 3.5 | 147.8 | 115.9 | 1.28 | 19.0 |
| 18 | 9.7 | 2.9 | 131.2 | 95.5 | 1.37 | 19.5 |
| 19 | 6.7 | 7.4 | 179.5 | 170.6 | 1.05 | — |
| 20 | 6.7 | 7.1 | 176.0 | 165.3 | 1.06 | — |
| 21 | 6.7 | 6.5 | 166.5 | 152.5 | 1.09 | 15.8 |
| 22 | 6.7 | 5.9 | 153.2 | 139.4 | 1.10 | 15.8 |
| 23 | 6.7 | 5.3 | 143.8 | 126.7 | 1.13 | 15.8 |
| 24 | 6.7 | 4.7 | 136.2 | 115.7 | 1.18 | 15.8 |
| 25 | 6.7 | 4.1 | 122.7 | 102.5 | 1.20 | 15.8 |
| 26 | 6.7 | 3.5 | 114.9 | 90.2 | 1.27 | 16.5 |
| 27 | 6.7 | 2.9 | 103.9 | 76.8 | 1.35 | 17.5 |

As shown in TABLE 1, the lean limit became higher as the surface-to-volume ratio S/V1 was increased. When the air-fuel ratio of the fuel-lean mixture (i.e. lean limit) becomes high, generation of carbon monoxide can be suppressed by complete combustion. Further, generation of nitrogen oxides can be suppressed with decrease in combustion temperature. In addition, the thermal efficiency of the engine can be improved by such lean combustion control.

It is considered that the higher the surface-to-volume ratio S/V1 (the larger the volume V1 of the protruding portion), the greater the influence of heat dissipation through the insulator and through the center electrode, the lower the lean limit. When $S/V1 \leq 1.06$ (sample No. 1, 2, 10, 11, 19 and 20), misfire of the engine occurred irrespective of the axial length L of the protruding portion. By increasing the ratio of the surface area S to the volume V of the protruding portion, the influence of heat dissipation can be reduced to increase the lean limit. When L=4.7 mm, misfire of the engine occurred irrespective of the surface-to-volume ratio S/V1.

When S/V1=1.38 (sample No. 9 and 18), pre-ignition occurred at ignition timing other than MBT timing. The reason for this is considered that it was difficult to dissipate heat from the protruding portion through the insulator because the ratio of the volume V to the surface area S of the protruding portion was low. When L>12.7 mm, there occurred pre-ignition irrespective of the ratio value S/V1.

It is apparent from the above test results that it is preferable to satisfy both of the conditions of $6.7 \leq L \leq 12.7$ and $1.07 \leq S/V1 \leq 1.35$ for the purpose of improving ignition performance while preventing pre-ignition.

Experiment 2

Sample ignition plugs (sample No. 28 to 36) were formed with reference to the sample No. 4. Further, sample ignition plugs (sample No. 35 to 45) were formed with reference to the sample No. 13. In these samples 28 to 45, the outer diameter D2 of the second region was set to 5.9 mm; and the thickness T of the second region was varied from sample to sample. The volume V1 of the protruding portion, the volume V2 of the front end portion of the center electrode and the volume V3 of the clearance space were changed by varying the thickness T of the second region, thereby providing different volume ratio values V2/V where V=V1+V2+V3.

(Evaluation of Ignition Performance and Heat Radiation Ability)

Each of the sample ignition plugs was mounted to the same engine as in Experiment 1 (1.6-liter four-cylinder DOHC engine) and tested for the ignition performance and heat dissipation ability. In the test, the engine was operated for 1000 cycles under the conditions of a speed of 1200 rpm, a load (net mean effective pressure (NMEP)) of 500 kPa and a stoichiometric air-fuel ratio, assuming a series of strokes of the engine as one cycle. An alternating voltage was applied to the ignition plug so as to control the ignition timing to MBT timing in each operation. The discharge voltage was set to 20 kV. The evaluation of the ignition performance was made on the basis of the COV of the NMEP. When the COV was 5% or lower, combustion was stable. When the COV was higher than 5%, combustion was not stable. The ignition performance was thus evaluated as "good (○)" when COV≤0.5% and as "poor (Δ)" when COV>5%. Further, the heat dissipation ability was evaluated as "good (○)" when there occurred no pre-ignition and as "insufficient (x)" when there occurred pre-ignition.

(Evaluation of Withstand Voltage)

Each of the sample ignition plugs was mounted to the same engine as in Experiment 1 (1.6-liter four-cylinder DOHC engine) and tested for the occurrence of perforation or cracking during operation of the engine. In the test, the engine was operated for 20 hours under the conditions of a speed of 1200 rpm, a load (net mean effective pressure (NMEP)) of 500 kPa and a stoichiometric air-fuel ratio. An alternating voltage was applied to the ignition plug so as to control the ignition timing to MBT timing in each operation. The discharge voltage was set to 20 kV. The withstand voltage of the insulator was evaluated as "proper (○)" when no perforation or cracking occurred in the insulator; and "insufficient (x)" perforation or cracking occurred in the insulator.

The test results are shown in TABLE 2. In TABLE 2, the volume ratio V2/V of the sample No. 29 is rounded off to the third decimal place; and the volume ratio V2/V of the sample No. 45 is rounded down to the third decimal place.

TABLE 2

| No. | L (mm) | T (mm) | V2 ($mm^3$) | V ($mm^3$) | V2/V | Withstand voltage | Ignition performance | Heat radiation |
|---|---|---|---|---|---|---|---|---|
| 28 | 12.7 | 0.70 | 184.2 | 353.8 | 0.52 | × | Δ | o |
| 29 | 12.7 | 0.75 | 175.2 | 353.8 | 0.495 | o | o | o |
| 30 | 12.7 | 0.80 | 166.6 | 353.8 | 0.47 | o | o | o |
| 31 | 12.7 | 1.00 | 134.2 | 353.8 | 0.38 | o | o | o |
| 32 | 12.7 | 1.20 | 110.0 | 353.8 | 0.31 | o | o | o |
| 33 | 12.7 | 1.60 | 61.4 | 353.8 | 0.17 | o | o | o |
| 34 | 12.7 | 2.00 | 29.5 | 353.8 | 0.08 | o | o | o |
| 35 | 12.7 | 2.40 | 9.6 | 353.8 | 0.03 | o | o | o |
| 36 | 12.7 | 2.60 | 3.7 | 353.8 | 0.01 | o | Δ | o |
| 37 | 9.7 | 0.70 | 136.6 | 271.7 | 0.50 | × | Δ | o |
| 38 | 9.7 | 0.75 | 129.6 | 271.7 | 0.48 | o | o | o |
| 39 | 9.7 | 0.80 | 122.9 | 271.7 | 0.45 | o | o | o |
| 40 | 9.7 | 1.00 | 98.3 | 271.7 | 0.36 | o | o | o |
| 41 | 9.7 | 1.20 | 80.1 | 271.7 | 0.29 | o | o | o |
| 42 | 9.7 | 1.60 | 44.2 | 271.7 | 0.16 | o | o | o |
| 43 | 9.7 | 2.00 | 21.0 | 271.7 | 0.08 | o | o | o |
| 44 | 9.7 | 2.40 | 6.8 | 271.7 | 0.03 | o | o | o |
| 45 | 9.7 | 2.60 | 2.6 | 271.7 | 0.009 | o | Δ | × |

As shown in TABLE 2, perforation or cracking occurred in the insulator during the withstand voltage test when $T \leq 0.7$ mm (sample No. 28 and 37). When $T \geq 2.60$ mm (sample No. 36 and 45), the COV exceeded 0.5% during the ignition performance test. It has thus been shown that it is preferable to satisfy the condition of $0.75 \leq T < 2.60$, more preferably $0.75 \leq T \leq 2.40$, for the purpose of ensuring both of withstand voltage and combustion stability.

Further, there occurred pre-ignition during the heat dissipation test when $V2/V < 0.01$ (sample No. 25). It has thus been shown that it is preferable to satisfy the condition of $V2/V \geq 0.01$ for the purpose of ensuring heat dissipation ability.

It is apparent from the above test results that it is particularly preferable to satisfy the conditions of $0.01 \leq V2/(V1+V2+V3) \leq 0.49$ and $0.75 \leq T \leq 2.40$ in terms of withstand voltage, combustion stability and heat dissipation ability.

Although the present invention has been described with reference to the above specific embodiments, it should be clearly understood that: the present invention is not limited to the above embodiments; and various changes and modifications of the above embodiments are possible without departing from the scope of the present invention.

For example, the above-mentioned shape and dimensions of the protruding portion 32, 61, 71 are merely examples and can be set as appropriate.

Although the conditions of $0.01 \leq V2/(V1+V2+V3) \leq 0.49$ and $0.75\ mm \leq T \leq 2.4\ mm$ are satisfied in the first embodiment, these conditions are not necessarily satisfied and can be satisfied arbitrarily.

In the second embodiment, the uneven section 65 is provided on the protruding portion 61 by forming a plurality of circumferentially continuous annular recesses in the outer surface of the protruding portion 61 at intervals apart from one another in the direction of the axis O. The uneven section 65 is not however limited to this form as long as the surface area S of the protruding portion 61 can be increased by the formation of the uneven section 65. It is feasible to provide the uneven section 65 by forming a plurality of projections and/or recesses on the outer surface of the protruding portion 61. The shapes of the projections and the recesses are not particularly limited. The projections and the recesses may extend in a circumferential direction, in the direction of the axis O or in a spiral direction.

In the third embodiment, an uneven section 65 can be formed on the protruding portion 71 of the insulator 30 as in the case of the second embodiment. It is possible by the formation of such an uneven section to increase the surface area S of the outer surface of the protruding portion 71 and thereby increase the amount of generation of non-equilibrium plasma on the protruding portion 71.

In the first to third embodiments, the metal shell 20 is fixed by crimping to the insulator 30 through the ring member 52 and the filling material 53. The fixing of the metal shell 30 is not however limited to such configuration. As a matter of course, the metal shell 20 can be fixed by crimping to the insulator 30 with no ring member 52 and no filling material 53.

The entire contents of Japanese Patent Application No. 2016-152704 (filed on Aug. 3, 2016) are herein incorporated by reference. The scope of the invention is defined with reference to the following claims.

DESCRIPTION OF REFERENCE NUMERALS

10: Ignition device
11, 60, 70: Ignition plug
12: Voltage application unit
20: Metal shell
30: Insulator
32, 61, 71: Protruding portion (Front end portion)
33, 62, 73: First region
34, 63, 73: Second region
38: Clearance space
40: Center electrode
41: Front end portion (side)
65: Uneven section
74: Third region
O: Axis Having described the invention, the following is claimed:

1. An ignition plug, comprising:

a center electrode extending along an axis of the ignition plug;

a bottomed cylindrical insulator enclosing a front end portion of the center electrode; and a cylindrical metal shell holding therein the insulator, the insulator having, on a front end side thereof, a protruding portion protruding from and located frontward of a front end of the metal shell, wherein a difference between an outer diameter of the center electrode and an inner diameter of the insulator is 0.01 mm or more;

wherein a length of the protruding portion in a direction of the axis is 6.7 mm to 12.7 mm; and wherein the following condition is satisfied:

$$1.07 \leq S/V1 \leq 1.35$$

where S is an area of an outer surface of the protruding portion; and V1 is a volume of the protruding portion.

2. The ignition plug according to claim 1, wherein the following condition is further satisfied:

$$0.01 \leq V2/(V1+V2+V3) \leq 0.49$$

where V2 is a volume of the front end portion of the center electrode located frontward of the front end of the metal shell; and, assuming a clearance between the insulator and the center electrode, V3 is a volume of a part of the clearance located frontward of the front end of the metal shell.

3. The ignition plug according to claim 2, wherein the protruding portion includes a first region formed with a first outer diameter and a second region located frontward of the first region and formed with a constant second outer diameter smaller than the first outer diameter; and wherein a thickness of the second region in a direction perpendicular to the axis is 0.75 mm to 2.4 mm.

4. The ignition plug according to claim 2, wherein the protruding includes a first region formed with a first outer diameter, a second region located frontward of the first region and formed with a constant second outer diameter smaller than the first outer diameter, and a third region extending between the first region and the second region; and wherein, when viewed in cross section along the axis, an outer surface of the third region has an tapered shape that gradually increase in diameter from the front toward the rear.

5. The ignition plug according to claim 1, wherein the outer surface of the protruding portion is formed with an uneven section.

6. An ignition device, comprising:

the ignition plug having a center electrode extending along an axis of the ignition plug;

a bottomed cylindrical insulator enclosing a front end portion of the center electrode; and a cylindrical metal shell holding therein the insulator, the insulator having, on a front end side thereof, a protruding portion protruding from and located frontward of a front end of the metal shell, wherein a difference between an outer diameter of the center electrode and an inner diameter of the insulator is 0.01 mm or more;

wherein a length of the protruding portion in a direction of the axis is 6.7 mm to 12.7 mm; and wherein the following condition is satisfied:

$$1.07 \leq S/V1 \leq 1.35$$

where S is an area of an outer surface of the protruding portion; and V1 is a volume of the protruding portion; and a voltage application unit that applies an alternating voltage or a plurality of voltage pulses to the center electrode of the ignition plug so as to generate non-equilibrium plasma at an outer side of the protruding portion of the insulator of the ignition plug.

* * * * *